US011055941B1

(12) United States Patent
Eber et al.

(10) Patent No.: US 11,055,941 B1
(45) Date of Patent: Jul. 6, 2021

(54) SYSTEM AND METHOD OF IMPROVING SECURITY DURING BACKUP FUNCTIONALITY OF ELECTRONIC CONTROL KEY

(71) Applicant: NXP B.V., Eindhoven (NL)

(72) Inventors: Wolfgang Eber, Styria (AT); Dorian Haslinger, Graz (AT)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 16/836,758

(22) Filed: Mar. 31, 2020

(51) Int. Cl.
*G07C 9/00* (2020.01)

(52) U.S. Cl.
CPC ..... *G07C 9/00904* (2013.01); *G07C 2009/00642* (2013.01)

(58) Field of Classification Search
None
See application file for complete search history.

(56) References Cited

U.S. PATENT DOCUMENTS 5,790,014 A * 8/1998 Campbell ..... B60R 25/24 307/10.4
7,420,455 B2 9/2008 Nowottnick
9,230,440 B1 * 1/2016 Penilla ..... G06Q 30/0643
9,328,531 B1 * 5/2016 Smeikle ..... G07C 9/00174
9,809,196 B1 * 11/2017 Penilla ..... B60R 25/33
10,440,576 B1 * 10/2019 Casamassima .... G07C 9/00309
2001/0033221 A1 * 10/2001 Thomas ..... B60R 25/2063 340/5.61
2002/0027161 A1 * 3/2002 Kakuta ..... G07C 9/00182 235/382
2002/0073349 A1 * 6/2002 Turner ..... G07B 17/00733 713/340
2002/0109582 A1 * 8/2002 Mooney ..... H02J 7/0045 340/5.65

(Continued)

FOREIGN PATENT DOCUMENTS

WO WO 01/25060 A2 4/2001
WO WO 2016/059451 A1 4/2016

OTHER PUBLICATIONS

Hamida et al., "Detecting Relay Attacks in RFID Systems Using Physical Layer Characteristics," ieee.org, IFIP WMNC Conference, 2013, 8 pages.

*Primary Examiner* — Curtis J King

(57) ABSTRACT

An electronic control key including security check circuitry used by an inductive system to perform at least one security check to determine whether to enable authorized functions. The inductive system receives power and enables communications via an inductive link for backup operation. The security check circuitry may include battery status circuitry and distance measurement circuitry. The inductive system invokes the distance measurement circuitry to perform a secure distance check when the battery status is good, in which the inductive system enables authorized functions only when the secure distance check passes. The security check circuitry may include a motion detector for performing a motion inquiry. The motion inquiry may include detecting motion of the electronic control key or detecting a predetermined characteristic movement or a programmed motion pattern. The security check circuitry may be a button in which authorized functions are enabled only when the button is pressed.

17 Claims, 6 Drawing Sheets

(56) References Cited

U.S. PATENT DOCUMENTS

2004/0039920 A1* 2/2004 Kim ..... E05B 65/462 713/185
2005/0166651 A1* 8/2005 Stoschek ..... B60R 25/406 70/264
2005/0168322 A1* 8/2005 Appenrodt ..... E05B 77/48 340/5.72
2006/0114100 A1* 6/2006 Ghabra ..... E05B 81/78 340/5.61
2007/0090965 A1* 4/2007 McCall ..... G08B 21/24 340/8.1
2008/0166651 A1* 7/2008 Vanbesien ..... G03G 9/08733 430/109.3
2009/0291637 A1* 11/2009 Alrabady ..... H04W 12/0013 455/41.2
2009/0328189 A1* 12/2009 Budyta ..... H04L 9/0838 726/14
2010/0321154 A1* 12/2010 Ghabra ..... G07C 9/00309 340/5.61
2011/0115605 A1* 5/2011 Dimig ..... H02J 50/80 340/5.61
2011/0148573 A1* 6/2011 Ghabra ..... B60R 25/245 340/5.61
2013/0252714 A1* 9/2013 Buchholz ..... G07F 17/3227 463/25
2014/0022052 A1* 1/2014 Lim ..... G08C 17/02 340/5.61
2014/0082569 A1* 3/2014 Borgman ..... H04W 12/08 715/863
2014/0176301 A1* 6/2014 Fernandez Banares ..... G07C 9/21 340/5.26
2015/0061920 A1* 3/2015 Pahlavan ..... G01S 13/765 342/125
2015/0116079 A1* 4/2015 Mishra ..... H04W 12/06 340/5.52
2016/0129883 A1* 5/2016 Penilla ..... G08G 1/146 348/148
2016/0214535 A1* 7/2016 Penilla ..... B60L 50/66
2016/0232726 A1* 8/2016 Zizi ..... G07C 13/00
2016/0350989 A1* 12/2016 Chang ..... H02J 50/00
2017/0301199 A1* 10/2017 Blaser ..... H04B 1/3877
2018/0208204 A1* 7/2018 Chen ..... G06F 1/163
2018/0208208 A1* 7/2018 Chen ..... B60R 16/037
2020/0029213 A1* 1/2020 Nolscher ..... B60R 25/24
2020/0122686 A1* 4/2020 Siswick ..... B60R 25/246
2020/0130771 A1* 4/2020 Jacobsz Rosier ..... B62J 45/40
2020/0219338 A1* 7/2020 Chen ..... G07C 9/29
2020/0254968 A1* 8/2020 Hassani ..... B60R 25/102
2020/0351665 A1* 11/2020 Kelly ..... G07C 9/00309

* cited by examiner

SYSTEM AND METHOD OF IMPROVING SECURITY DURING BACKUP FUNCTIONALITY OF ELECTRONIC CONTROL KEY

BACKGROUND

Field of the Invention

The present invention relates in general to electronic control keys, and more particularly to a system and method of improving security during backup functionality of an electronic control key.

Description of the Related Art

An electronic control key, or "key fob," is a keyless entry remote device which may be used to perform one or more authorized functions, such as locking or unlocking doors or the like for controlling access to vehicles or other controlled locations (e.g., hotel rooms, apartments, buildings, secure areas, etc.), opening a trunk, activating an alarm, starting an engine, etc. Modern electronic control keys may include wireless communication technology, such as 5G, Wi-Fi, Bluetooth, Bluetooth Low Energy (BLE), etc., for communicating with a corresponding access control system or the like at the vehicle or other secure location. The electronic control key and the access control system may include additional wireless technologies, such as ultra-wide band (UWB) or the like, for performing secure distance measurements such as proximity determinations between the electronic control key and the access control system. A UWB device, for example, may be used to determine when the electronic control key is within a predetermined threshold distance to facilitate access or other control decisions. The electronic control key typically includes a battery that provides power to the wireless communication devices. The term "electronic control key" as used herein contemplates many different configurations of electronic control devices, including conventional vehicle key fob devices and various other electronic Smart Device configurations, such as Smart-FOBs, Smart cards, Smart watches, mobile or cellular phones, etc.

When the battery of the electronic control key is dead or otherwise disconnected, the battery-powered primary communication circuitry of the electronic control key may be disabled or otherwise unavailable. For this reason, electronic control keys may include backup communication circuitry remotely powered and controlled. The backup communication circuitry may be independent and secure so that it independently performs the same functions and applications of the primary communication circuitry including secure cryptographic and key store functions. An inductive element may be provided on the electronic control key that inductively links with the access control system to establish an inductive power and communication link. Existing automotive systems, for example, may use low frequency (LF) technologies in which the cable length to the central base station is critical, or may use near-field communication (NFC) technologies in which the reader electronics are integrated into each coupling device.

There are several security issues with current and proposed backup communication circuitry of electronic control keys and the like. A secure distance check (distance measurement) is typically performed during normal battery-powered operation to ensure that an authorized electronic control key is within a predetermined security distance threshold, in which the secure distance measurement typically requires active communication and thus needs the battery supply. The backup communication circuitry, however, does not use the battery and thus may not be configured to perform the secure distance test. This backup vulnerability can be used by an attacker or a hacker as a backdoor access method to avoid or otherwise bypass the secure distance check. The hacker uses the backup vulnerability to perform a forced backup mode attack to avoid the secure distance check. As an example, the hacker has equipment that performs a relay attack while the authorized electronic control key is outside the secure distance threshold.

BRIEF DESCRIPTION OF THE DRAWINGS

Embodiments of the present invention are illustrated by way of example and are not limited by the accompanying figures. Similar references in the figures may indicate similar elements. Elements in the figures are illustrated for simplicity and clarity and have not necessarily been drawn to scale.

DETAILED DESCRIPTION

The inventors have recognized the vulnerability of battery-powered electronic control keys (a.k.a., key fobs) that include backup functionality. They have therefore developed a system and method of improving security by performing at least one security check during backup functionality of electronic control keys. In some embodiments, the status of the electronic control key battery is evaluated and if available and sufficiently charged, a secure distance check is mandatory and performed to avoid an attack when the authorized electronic control key is beyond the security distance threshold. In other embodiments, the electronic control key includes a motion detector that it used to perform a motion inquiry in which an attack may be avoided when the authorized electronic control key is stationary or otherwise does not move in accordance with a programmed motion pattern. The motion inquiry may be a simple motion, or it may be more sophisticated motion such as comparing actual motion detected by the motion detector with a predetermined or programmed user-defined characteristic movement of the electronic control key. In other embodiments, a button is added or an existing button is re-purposed and authorized functions are enabled only when the button is pressed. In still other embodiments, a combination of the security checks may be enabled.

The electronic control key includes an inductive system that enables backup communications via an inductive link typically used when the electronic control key battery is disconnected or not sufficiently charged. The inductive system establishes authorized communications via the inductive link and further enables authorized functions to be commanded via the inductive link. As further described herein, even if authorized communications are established using the inductive link, the inductive system does not enable the authorized functions when any of the at least one security check fails. The security check can be battery status combined with secure distance check, or authorized motion check, or a combination of security check methods.

Figure 1:
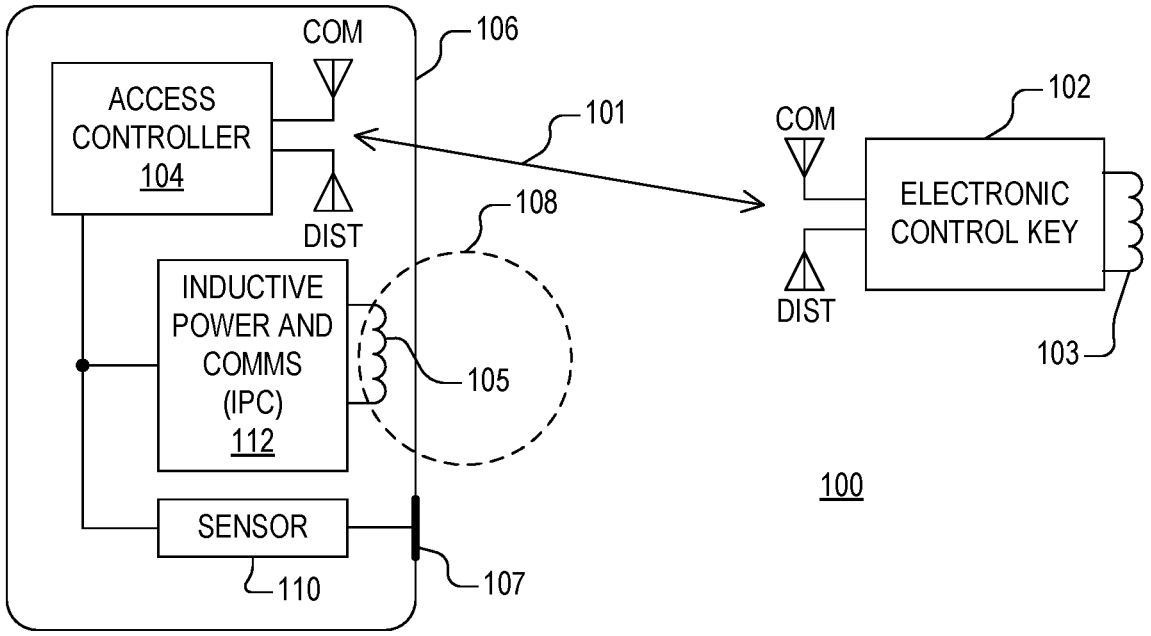
FIG. 1 is a simplified block diagram of a key-based access system implemented according to one embodiment of the present disclosure.

FIG. 1 is a simplified block diagram of an electronic key-based control system 100 implemented according to one embodiment of the present disclosure. An electronic control key 102 is configured to establish authorized wireless communications with an access controller 104 contained within a vehicle 106, such as an automobile, van, SUV, truck or the like. The vehicle 106 may also represent any type of controlled location, such as, for example, hotel rooms, apartments, buildings, secure areas, etc. The electronic control key 102 may be used to perform a variety of different authorized functions, such as locking/unlocking doors, opening a trunk, activating an alarm, starting an engine of the vehicle 106, etc. The electronic control key 102 and the access controller 104 may each be equipped with wireless communication circuitry that are configured to wirelessly communicate with each other to perform wake up, connection, and communication tasks for access, control and data transfer functions and the like, and for also performing distance measurements between the electronic control key 102 and the vehicle 106.

As shown, each includes a communication (COM) antenna coupled to internal communication circuitry for performing the primary communications. In one embodiment, for example, each may include a wireless Bluetooth device configured to operate according to the Bluetooth wireless standard including low power versions, such as Bluetooth Low Energy (BLE). Although Bluetooth and BLE are commonly used for such functions, alternative wireless communication technologies are also contemplated for performing the same or similar functions, such as 5G or Wi-Fi and the like. In addition, the electronic control key 102 and the access controller 104 may each be equipped with additional wireless communication circuitry configured to wirelessly communicate with each other to perform distance (DIST) measurements or and the like for localization functions including determining the relative proximity of the electronic control key 102. As shown, for example, each includes a distance antenna DIST coupled to internal communication circuitry for performing wireless communications associated with measuring a distance between the electronic control key 102 and the access controller 104. In one embodiment, for example, each may include an ultra-wideband (UWB) device configured to operate using UWB technology.

During normal operation, an authorized user (e.g., user 302 shown in FIG. 3) uses the electronic control key 102 to perform any of one or more different authorized functions, such as locking/unlocking doors, opening a trunk, activating an alarm system, starting an engine of the vehicle 106, etc. Many of these authorized functions may be activated by one or more pushes of one or more buttons other interfaces provided on the electronic control key 102. Other authorized functions, such as passive keyless entry (PKE), may be performed without human action. When the electronic control key 102 is within a predetermined threshold distance 101 from the vehicle 106, an authorized wireless communication session may be established to allow wireless communications between the electronic control key 102 and the access controller 104 to perform any of the desired authorized functions. The threshold distance 101 is a predetermined to ensure that the electronic control key 102 is nearby the vehicle 106 for enabling the authorized functions. In one embodiment, the predetermined threshold distance 101 is on the order of a few meters, such as 2-3 meters or the like, although any suitable distance threshold less than or greater than 2-3 meters is contemplated. The electronic control key 102 may include memory or the like storing a secure key or code which may be encrypted and transferred for purposes of authentication. The COM and DIST functions are supported by corresponding communication circuitry, described further below, powered by a battery or the like.

When the battery of the electronic control key 102 is absent, disconnected, or dead (or substantially discharged), then the normal wireless communications, including COM and DIST functions, might not be functional such as is the case for legacy or conventional key fob configurations. The electronic control key 102 includes an inductive element 103 which may be used to establish an inductive link with a corresponding inductive element 105 located on or within the vehicle 106. The inductive elements 103 and 105 may each be implemented as physical inductors, although alternative inductive configurations are contemplated. When the inductive elements 103 and 105 are sufficiently close to one another, such as within a predetermined coupling zone 108, then the inductive link may be established for providing power and for establishing communications with the electronic control key 102. In one embodiment, the location of the inductive element 105 of the vehicle 106 is marked or otherwise known by the user, such as at or near a door handle or the like. The coupling zone 108 may be a predetermined distance, such as 5-8 centimeters (or 2-3 inches) or the like. The user positions the electronic control key 102 so that the inductive element 103 of the electronic control key 102 is within the coupling zone 108 of the inductive element 105.

Various methods are contemplated for detection of the presence of the electronic control key 102. In the illustrated embodiment, a sensor 110 is provided on or within the vehicle 106. The sensor 110 may be configured according to any suitable method and may include a sensor interface 107 configured according to the particular sensor type. The sensor interface 107 may a button, an inductive object detector, a capacitive sensor, etc. In one embodiment, the sensor interface 107 may be sufficiently close to the inductive element 105 for detecting the inductive element 103 when within the coupling zone 108. In another embodiment, the sensor interface 107 is a button that is pressed by a user. In yet another embodiment, the sensor interface 107 may be a touch pad or the like configured as a capacitive sensor. In yet another embodiment, the sensor 110 is avoided and the inductive element 105 itself may be used as the sensing device. Once proximity is detected indicating a possible inductive link, the sensor 110 wakes up or otherwise activates the access controller 104. Either the sensor 110 or the access controller 104 activates inductive power and communication (IPC) circuitry 112 electrically interfaced with the inductive element 105. If the inductive element 105 is the sensing device, then the IPC circuitry 112 may detect low inductive power and awaken.

When activated, the IPC circuitry 112 energizes the inductive element 105 to transfer power to the electronic control key 102 via the inductive element 103. The inductive link between the inductive elements 103 and 105 is also used for backup communications between the electronic control key 102 and the access controller 104. In one embodiment, the access controller 104 communicates with the electronic control key 102 via the IPC circuitry 112 and the inductive element 105. In an alternative embodiment, the IPC circuitry 112 is configured to perform duplicate communications rather than the access controller 104. The inductive link may use low frequency (LF) technologies or near-field communication (NFC) technologies or the like.

Figure 2:
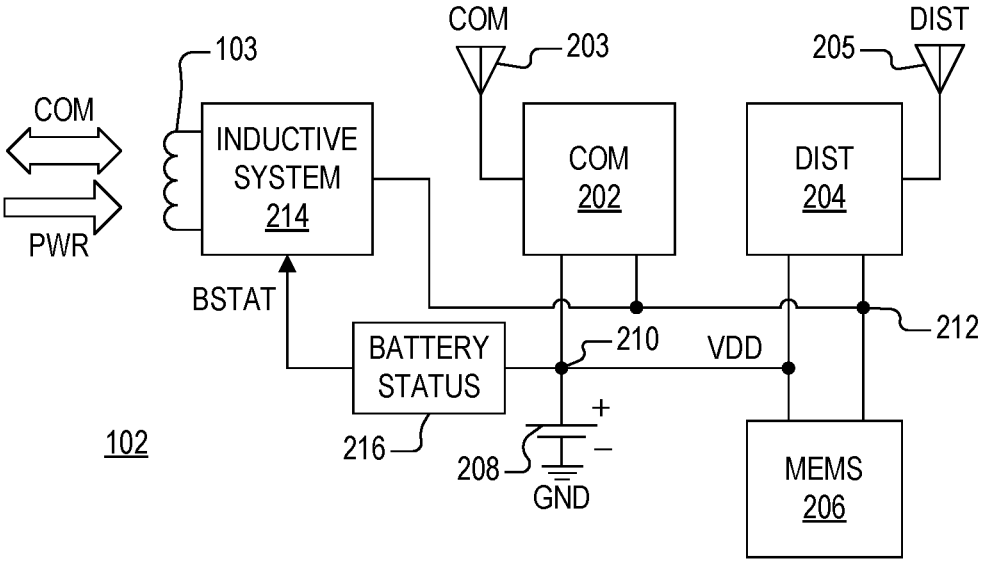
FIG. 2 is a simplified schematic and block diagram of the circuitry of the electronic control key of FIG. 1 implemented according to one embodiment of the present disclosure including battery status circuitry for security check.

FIG. 2 is a simplified schematic and block diagram of the circuitry of the electronic control key 102 implemented as a key fob according to one embodiment of the present disclosure. The circuitry includes communication (COM) circuitry 202 for performing the COM functions via a COM antenna 203, distance (DIST) circuitry 204 for performing the DIST functions via a DIST antenna 205, and micro-electromechanical system (MEMS) circuitry 206. The COM circuitry 202 establishes primary wireless communications with corresponding COM circuitry (not shown) of the access controller 104. In the illustrated embodiment, the COM circuitry 202 is used for the primary communication method between the electronic control key 102 and the access controller 104 for performing various tasks including wake up, connection and other communication tasks including the authorized COM functions. The DIST circuitry 204 operates according to a selected wireless technology, such as UWB technology or the like, for distance measurements for localization of the electronic control key 102. The MEMS circuitry 206 performs energy harvesting functions. The electronic control key circuitry further includes a battery 208 having a negative terminal coupled to ground (GND) and a positive terminal coupled to a power supply node 210 developing a supply voltage VDD.

The battery circuitry is shown in simplified format and additional circuitry may be included. For example, a diode or other rectifier circuit may be interposed between the battery 208 and the power supply node 210. A filter capacitor and a voltage limiter (e.g., a Zener diode or the like) may also be coupled between the power supply node 210 and GND. The power supply node 210 is coupled to power inputs of the COM circuitry 202, the DIST circuitry 204, and the MEMS circuitry 206. A communication bus 212 is provided to enable internal communications between the COM circuitry 202, the DIST circuitry 204, and the MEMS circuitry 206, and may be implemented in any suitable manner such as, for example, a serial peripheral interface (SPI) or the like.

During normal operation, the battery 208 is present and sufficiently charged to enable operation of the COM circuitry 202 and the DIST circuitry 204. The DIST circuitry 204 measures the distance between the electronic control key 102 and the vehicle 106. When the electronic control key 102 is within the predetermined threshold distance 101 from the vehicle 106, the COM circuitry 202 is enabled to establish an authorized wireless communication session to perform any of the desired functions. It is noted that the COM circuitry 202 and the DIST circuitry 204 of the electronic control key 102 may be combined into a single wireless communication device performing the functions of both. When BLE or the like is used for performing the COM functions, however, BLE may not be able to perform proper localization in a targeted environment with acceptable speed, so that UWB circuitry or the like is better suited for the DIST functions. When the battery 208 is absent, disconnected or not sufficiently charged, then the COM circuitry 202 and the DIST circuitry 204 may not be enable or otherwise may not be available to perform the normal functions.

The circuitry of the electronic control key 102 further includes an inductive system 214 coupled to the inductive element 103. The inductive system 214 may further be coupled to other circuitry of the electronic control key 102, such as via the communication bus 212. When the inductive element 103 of the electronic control key 102 is placed sufficiently close to the inductive element 105 (e.g., within the coupling zone 108) and when the IPC circuitry 112 is activated forming an inductive link, then the IPC circuitry 112 may deliver power (PWR) to the inductive system 214 and may enable communications (COM) with the inductive system 214. In one embodiment, for example, the inductive link may be configured with low frequency (LF) technology. In another embodiment, the inductive link may perform near-field communications (NFC) according to ISO/IEC (International Organization for Standardization/International Electrotechnical Commission) 14443 or the like. The inductive system 214 may be implemented in any suitable fashion, such as an SE050 integrated circuit (IC) manufactured by NXP Semiconductors.

The COM functions normally performed by the COM circuitry 202 are essentially duplicated by the inductive system 214 using the inductive link. The DIST functions, however, may not be available when the battery 208 is not available or is discharged. Since the inductive link is typically established when the inductive element 103 of the electronic control key 102 is within the coupling zone 108 of the inductive element 105, then the DIST functions might otherwise be considered extraneous. It has been determined, however, that this backup link opens up a back-door vulnerability that renders the system vulnerable to an attack by a hacker. Such an attack may allow the unauthorized hacker to perform any of the otherwise authorized functions, including gaining access to and control of the vehicle 106.

The circuitry of the electronic control key 102 further includes battery status circuitry 216 coupled to the battery 208 or otherwise coupled to the power supply node 210 and provides a battery status indication BSTAT to the inductive system 214. The battery status circuitry 216 may be configured to perform one or more functions for determining the status of the battery 208. For example, if the battery voltage level or the voltage level of VDD indicates that the battery 208 is present and sufficiently charged, then BSTAT provides a GOOD indication. Otherwise, if the battery 208 is not detected or if the voltage level of the battery 208 or of VDD is below a predetermined threshold, then BSTAT provides a NOT GOOD indication. BSTAT may be a digital or binary signal with a single bit, or it may include multiple bits depending upon the configuration. For example, BSTAT may indicate battery presence and whether the battery voltage or the voltage of the power supply node 210 is above a predetermined level.

The battery status circuitry 216 may be implemented in any suitable manner. In one embodiment, the battery status circuitry 216 may include a comparator or the like that compares the voltage of the battery 208 or the voltage level of VDD with a predetermined minimum voltage threshold. In addition or in the alternative, the battery status circuitry 216 may include circuitry that momentarily applies a minimum load to the battery 208 or to VDD to ensure that the indicated voltage level accurately reflects the charge of the battery 208 rather than spurious capacitance charge or the like. The battery status circuitry 216 may also be a simple conductor that conveys the voltage of the battery 208 or VDD to the inductive system 214, which is configured to compare the voltage level of the battery 208 or VDD or to test the charge of the battery 208.

As further described herein, if the inductive system 214 is being used for communications (COM) and BSTAT indicates GOOD, then the inductive system 214 communicates with the DIST circuitry 204 to perform a secure distance check to determine whether the electronic control key 102 is within the predetermined threshold distance 101 from the vehicle 106. If the secure distance check passes, meaning that the electronic control key 102 is within the predetermined threshold distance 101 from the vehicle 106, then the inductive system 214 is enabled to perform authorized functions. If the secure distance check fails, then it is assumed that an unauthorized attack is being attempted and additional communications are disabled or otherwise not allowed. If BSTAT indicates that the status of the battery 208 is NOT GOOD, then the backup communications and authorized functions may be enabled.

Figure 3:
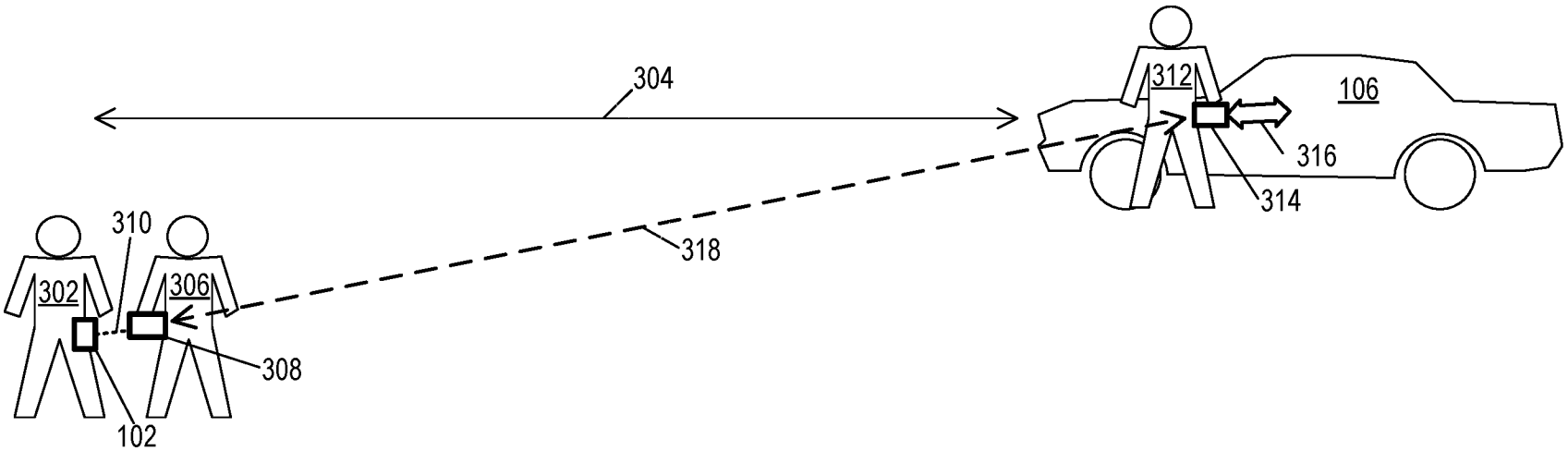
FIG. 3 is a figurative diagram illustrating an attack scenario in which the inductive system of FIG. 2 is used as the backup mode facilitating a relay including the battery status circuitry.

FIG. 3 is a figurative diagram illustrating an attack scenario in which the inductive system 214 is used as the backup mode facilitating a relay attack as further described herein. The authorized user 302 in possession of the electronic control key 102 is located a distance 304 from the vehicle 106, in which the distance 304 is greater than the predetermined threshold distance 101. A first thief 306 places first attack equipment 308 sufficiently close to the electronic control key 102 to establish an inductive link 310 with the electronic control key 102. A second thief 312 located near the vehicle 106 places second attack equipment 314 sufficiently close to the inductive element 105 to establish an inductive link 316 with the IPC circuitry 112. The first and second attack equipment 308 and 314 communicate with each other via wireless link 318 to relay communications.

The second attack equipment 314 is either sensed directly or its presence indicated by the second thief 312 in the manner previously described. The IPC circuitry 112 is activated and begins sending information (from the access controller 104 or directly from the IPC circuitry 112) to the second attack equipment 314 via the inductive link 316. The transmitted information from the IPC circuitry 112 is relayed to the first attack equipment 308 and to the inductive system 214 of the electronic control key 102 via the relayed communication links 318 and 310. The inductive system 214 of the electronic control key 102 provides responses which are relayed via communication links 310, 318 and 316 by the first and second attack equipment 308 and 314 to the IPC circuitry 112. Essentially, communications looping between the IPC circuitry 112 and the inductive system 214 are relayed back and forth by the attack equipment 308 and 314 as though they were communicating directly with each other. In this manner, the IPC circuitry 112, or the access controller 104 communicating via the IPC circuitry 112, may otherwise be fooled into enabling the functions that are only authorized for the electronic control key 102, possibly enabling unauthorized access and control of the vehicle 106 to the second thief 312.

The electronic control key 102, however, includes the battery status circuitry 216 queried by the inductive system 214 for thwarting the illustrated attack scenario. In particular, before enabling authorized functions, the inductive system 214 queries BSTAT to determine the status of the battery 208. If BSTAT indicates that the status of the battery 208 is NOT GOOD (not present or not sufficiently charged), then normal backup communications are enabled to perform the authorized functions. If BSTAT indicates that the status of the battery 208 is GOOD, then the inductive system 214 communicates with the DIST circuitry 204 to perform a secure distance check with the access controller 104. If the secure distance check passes, meaning that the electronic control key 102 is within the threshold distance 101, then normal backup communications are enabled to perform the authorized functions. If, however, the secure distance check fails, such as the case shown in FIG. 3 when the electronic control key 102 is located at the distance 101 beyond the predetermined threshold distance 101, then the secure distance test fails and the inductive system 214 does not enable the authorized functions.

Figure 4:
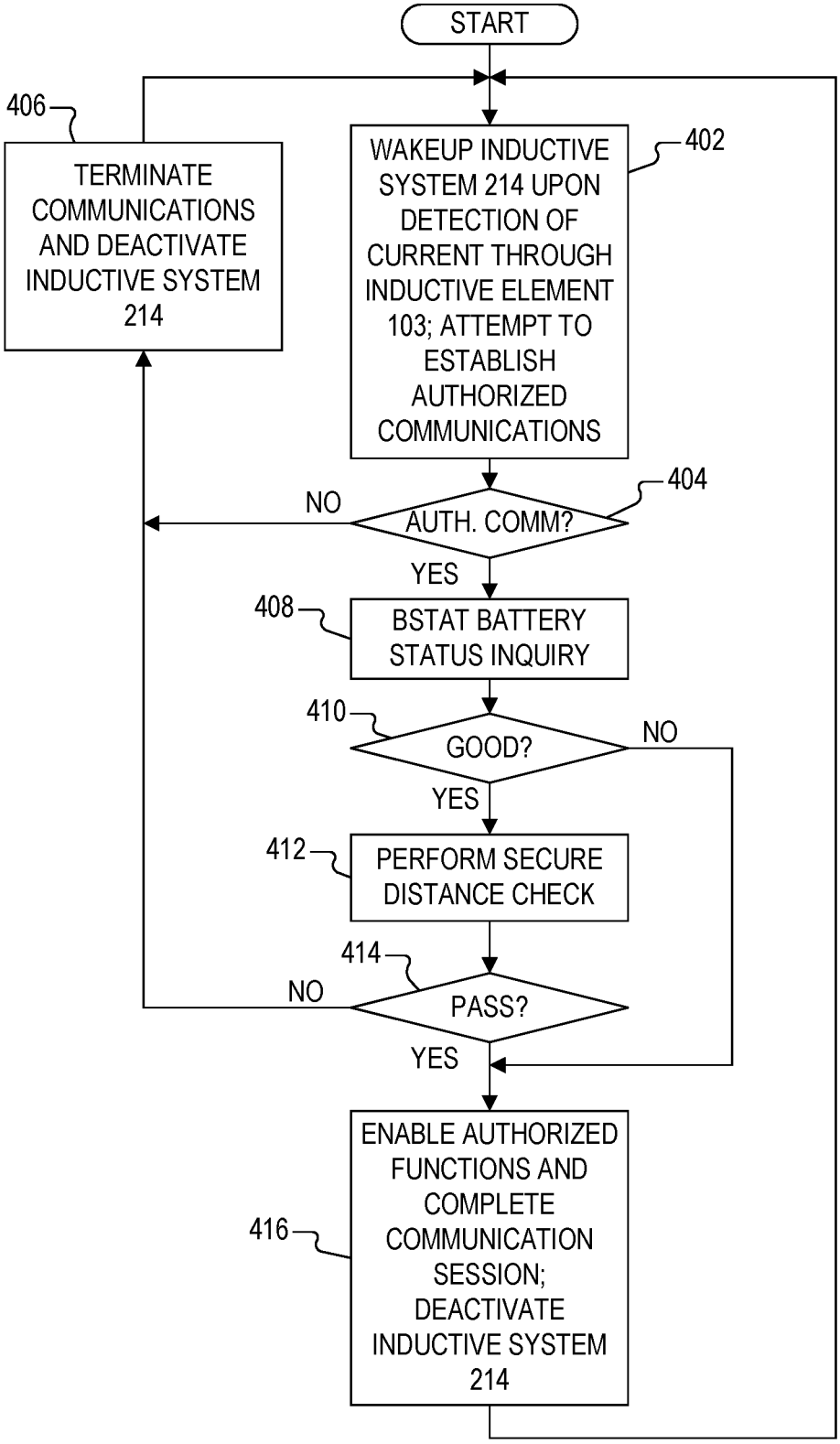
FIG. 4 is a flowchart illustrating operation of the electronic control key of FIG. 2 during inductive linking according to one embodiment of the present disclosure.

FIG. 4 is a flowchart illustrating operation of the electronic control key 102 during inductive linking according to one embodiment of the present disclosure. At first block 402, the inductive system 214 is awakened upon detection of current through the inductive element 103 of the electronic control key 102, and the inductive system 214 attempts to establish authorized communications with the IPC circuitry 112 or with the access controller 104 via the IPC circuitry 112. Although not shown in FIG. 4, the electronic control key 102 (or other inductive device) is first detected by the sensor 110 (or the IPC circuitry 112) and the access controller 104 is awakened to attempt to establish communications. If communications with the COM circuitry 202 is unsuccessful, then the access controller 104 awakens the IPC circuitry 112 (if not already activated) to begin providing power via the inductive element 105. The current through the inductive element 105 induces current through the inductive element 103 awakening the inductive system 214.

At next block 404, it is queried whether the inductive system 214 begins to establish authorized communications with the IPC circuitry 112 or with the access controller 104 via the IPC circuitry 112. Authorized communications may be established according to any known methods, such as including secure cryptographic and key store functions or the like. If authorized communications are not established, such as when the electronic control key 102 is attempting to communicate with another system with which it is not authorized, then operation advances to block 406 in which the communications are terminated and the inductive system 214 is deactivated. Operation then loops back to block 402 in which the inductive system 214 remains asleep until subsequently awakened.

If authorized communications are established as determined at block 404, then operation advances instead to block 408 in which the inductive system 214 queries BSTAT to determine the status of the battery 208. It is noted at this point that authorized communications may actually be established between the electronic control key 102 and the vehicle 106 during an attack scenario as shown and described in FIG. 3 since authorized communications are relayed by the first and second attack equipment 308 and 314. Nonetheless, the authorized functions are not yet enabled by the electronic control key 102. Operation then advances to block 410 to query the battery status. If BSTAT indicates that the battery status is GOOD, meaning that the battery 208 is present and sufficiently charged for normal operation, then operation advances to block 412 in which the inductive system 214 communicates with the DIST circuitry 204 to perform a secure distance check. At next block 414, it is queried whether the secure distance check passed or failed. If the secure distance check failed (e.g., PASS is false), meaning that the electronic control key 102 is located beyond the predetermined threshold distance 101 from the vehicle 106, then an attack scenario is presumed and operation loops back to block 406 in which the communications are terminated and the inductive system 214 is deactivated as previously described. In this case, the attack scenario is thwarted.

If instead the secure distance check passed as determined at block 414 (e.g., PASS is true), meaning that the electronic control key 102 is located within the predetermined threshold distance 101 from the vehicle 106, then operation advances instead to block 416 in which the authorized functions are enabled by the inductive system 214, the current communication session is completed, and then the inductive system 214 is deactivated and put back to sleep. Operation is completed and may loop back to block 402 previously described. In this case the electronic control key 102 is nearby and the authorized user 302 may be using the inductive link even when the status of the battery 208 is good.

Referring back to block 410, if BSTAT instead indicates that the battery status is NOT GOOD, meaning that the battery 208 is either not present or is not sufficiently charged for normal operation, then operation instead advances directly to block 416 in which the authorized functions are enabled by the inductive system 214, the current communication session is completed, and then the inductive system 214 is deactivated and put back to sleep. Operation is completed and may loop back to block 402 previously described. In this case, the status of the battery 208 is not good so that backup functionality is enabled presumably for the authorized user 302.

Figure 5:
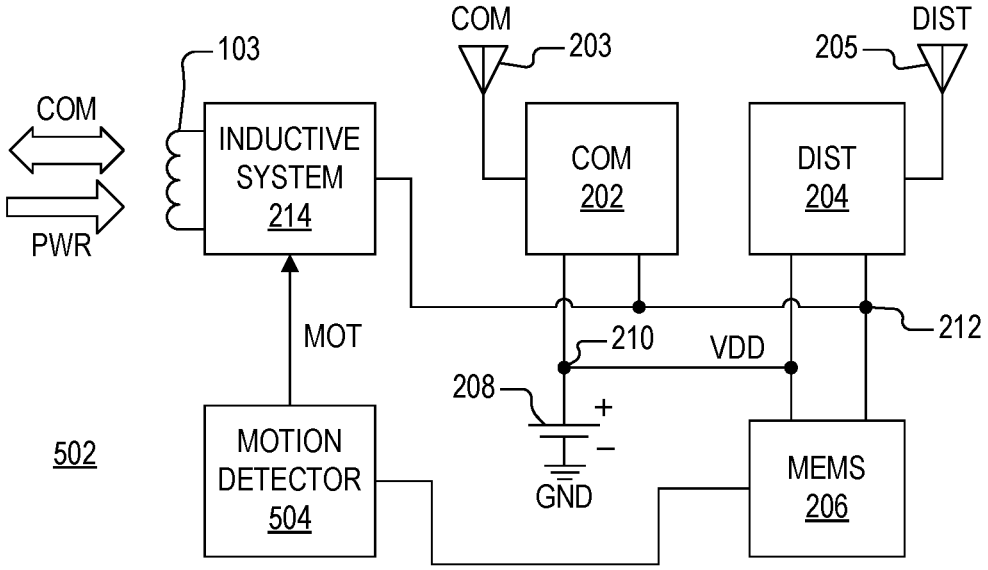
FIG. 5 is a simplified schematic and block diagram of circuitry of an electronic control key implemented according to another embodiment of the present disclosure including a motion detector for security check.

FIG. 5 is a simplified schematic and block diagram of circuitry of an electronic control key 502 implemented according to another embodiment of the present disclosure. The electronic control key 502 is substantially similar to the electronic control key 102 in which similar components include identical reference numbers. The COM circuitry 202, the DIST circuitry 204, and the MEMS circuitry 206 are included and coupled to communicate via the communication bus 212 in similar manner. Also, the battery 208 is included to develop the supply voltage VDD on the power supply node 210 in similar manner, in which VDD is distributed to the COM circuitry 202, the DIST circuitry 204, and the MEMS circuitry 206. The battery status circuitry 216 is not shown, but may be included in an alternative embodiment. The electronic control key 502 includes a motion detector 504 coupled to the MEMS circuitry 206 and providing a motion signal MOT to the inductive system 214. The inductive system 214 operates in a similar manner as previously described, except that it is configured to monitor the MOT signal for making decisions regarding enablement of the access and control functions as further described herein.

Figure 6:
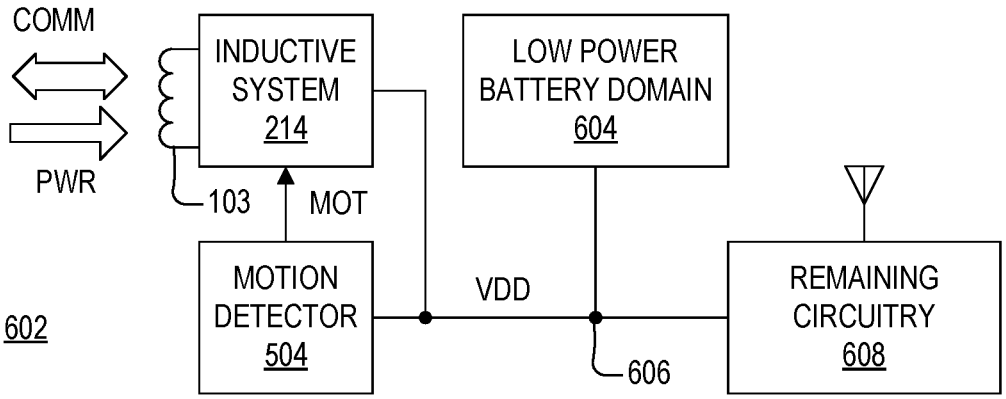
FIG. 6 is a simplified schematic and block diagram of circuitry of a mobile phone implementing an electronic control key according to yet another embodiment of the present disclosure including a motion detector.

FIG. 6 is a simplified schematic and block diagram of circuitry of a mobile phone 602 implemented according to yet another embodiment of the present disclosure. The mobile phone 602 may include the motion detector 504 and the inductive system 214 that operate in a similar manner as the electronic control key 502. The mobile phone 602 includes a low power battery domain 604 that develops and provides the supply voltage VDD to the motion detector 504 and the inductive system 214 via a power supply node 606. The mobile phone 602 also includes remaining circuitry 608 coupled to the power supply node 606 which includes mobile phone circuitry not further described.

Figure 7:
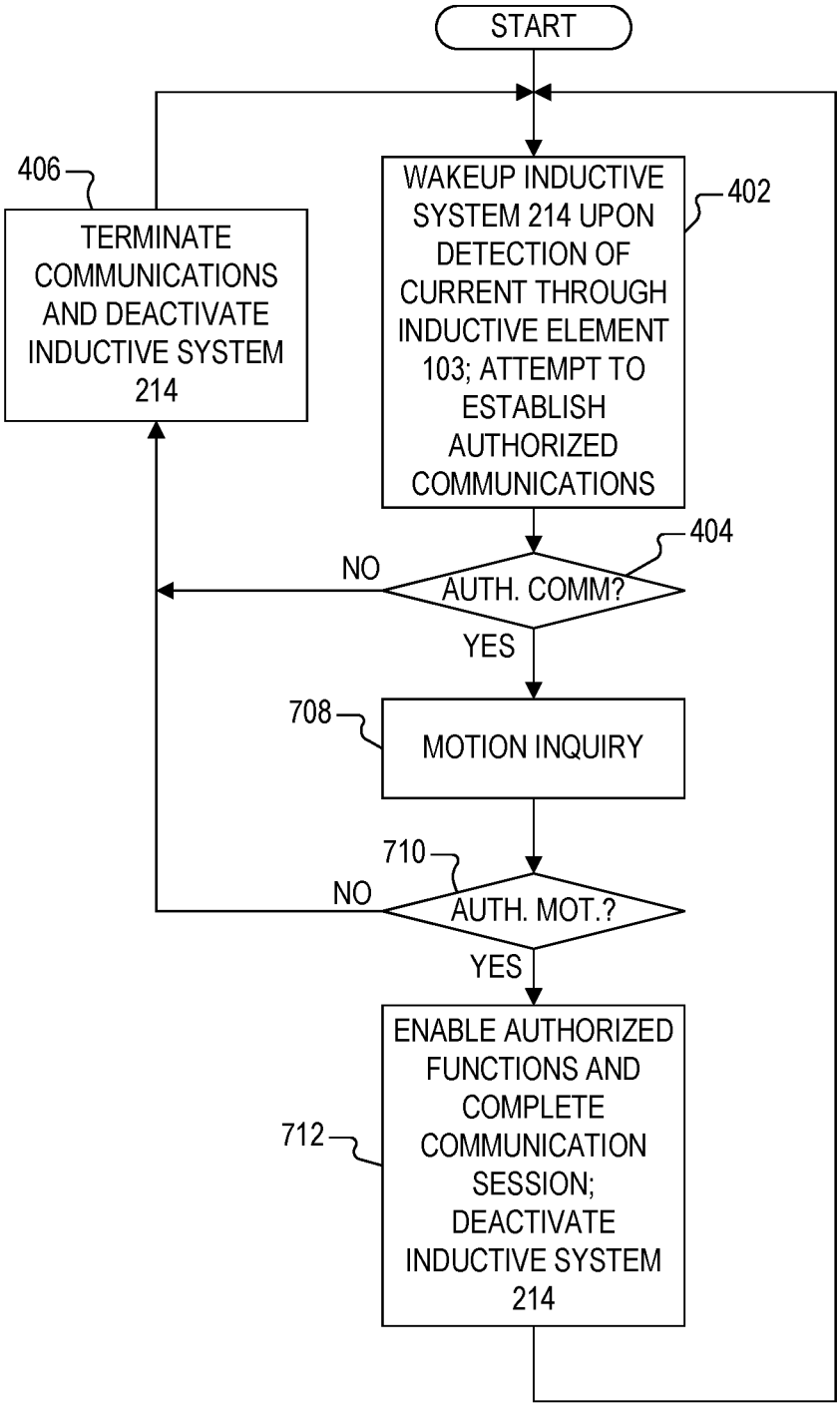
FIG. 7 is a flowchart illustrating operation of the electronic control keys of FIG. 5 or FIG. 6 during inductive linking according to one embodiment of the present disclosure.

FIG. 7 is a flowchart illustrating operation of the electronic control key 502 or the mobile phone 602 during inductive linking according to one embodiment of the present disclosure. The blocks 402, 404, and 406 are included and operate in substantially similar manner as previously described in FIG. 4 for the electronic control key 102. When authorized communications are established as determined at block 404, operation advances to block 708 in which the inductive system 214 monitors the MOT signal from the motion detector 504 to perform a motion inquiry.

Operation then advances to block 710 in which the inductive system 214 determines whether motion of the electronic control key 502 or the mobile phone 602 is an "authorized" motion further defined herein. If the motion is not authorized, then the authorized functions are not enabled and operation loops back to block 406 in which communications are terminated and the inductive system 214 deactivated.

If instead the motion is authorized, then operation advances to block 712, similar to block 416 previously described, in which the authorized functions are enabled by the inductive system 214, the current communication session is completed, and then the inductive system 214 is deactivated and put back to sleep. Operation is completed and may loop back to block 402 previously described. In this case the decision to enable the authorized functions is determined by an authorized motion.

In one embodiment, an authorized motion is simply any significant motion at all, meaning that the electronic control key 502 or the mobile phone 602 is in motion. With reference back to FIG. 3 in which the attack scenario is illustrated, presumably the inductive link 310 between the attack equipment 308 and the authorized device, which in this case is with the electronic control key 502 or the mobile phone 602, is enabled only while the authorized device is stationary. The inductive link 310 is likely not successful while the authorized device is in motion. If the authorized device is stable and not moving as indicated by the MOT signal, then an attack scenario is presumed and authorized functions are not enabled. In this embodiment, if the authorized user 302 uses the authorized device, such as either the electronic control key 502 or the mobile phone 602, in the backup mode to access the vehicle 106, then the user 302 positions the authorized device within the predetermined coupling zone 108 and moves the authorized device until the authorized functions are enabled. It is noted that while the authorized device remains stationary, similar positioning and motion of the second attack equipment 314 at the vehicle 106 is not successful in enabling the authorized functions so that the attack remains unsuccessful.

In another embodiment, the authorized motion detected as block 708 is a predetermined, user-defined and programmable motion pattern of the authorized device, such as either the electronic control key 502 or the mobile phone 602. In this case, the authorized user 302 initially or preliminarily performs a motion training session by placing the authorized device in a programming mode and moves the authorized device in an arbitrary motion pattern or in any one of many different predetermined motion patterns. Many different types of motion patterns are contemplated, such as a circular motion including one or more circle motions in a selected direction (clockwise or counterclockwise), a figure-8 pattern, a crossing pattern, etc. Of course, other types of motions including arbitrary motions are contemplated as long as sufficiently complex. Once programmed with the selected motion pattern, then the authorized functions are only enabled by the inductive system 214 when the authorized device duplicates the programmed motion pattern as indicated by the MOT signal generated by the motion detector 504.

Referring back to FIG. 3 illustrating the attack scenario, even if the authorized device (electronic control key 502 or mobile phone 602) is moving during the attack, it is very unlikely that it is moving in the programmed motion pattern so that the attack is thwarted. In addition, the authorized device must duplicate the programmed motion pattern rather than the second attack equipment 314. In other words, even if the second thief 312 moves the second attack equipment 314 to somehow duplicate the programmed motion pattern, the attack is unsuccessful.

Figure 8:
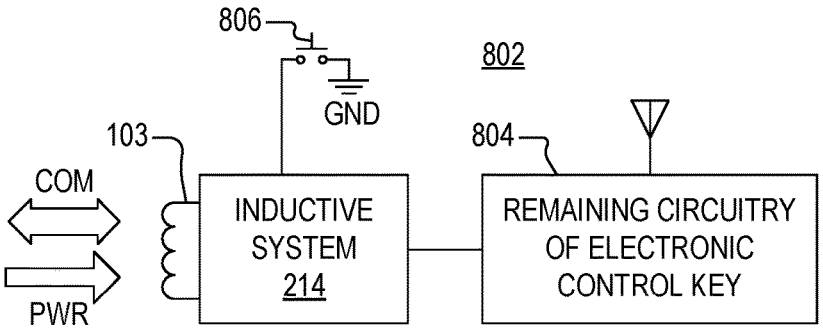
FIG. 8 is a simplified block diagram of an electronic control key implemented according to still another embodiment of the present disclosure including a button for security check.

FIG. 8 is a simplified block diagram of an electronic control key 802 implemented according to still another embodiment of the present disclosure. The electronic control key 802 includes the inductive system 214 coupled to the inductive element 103 in a similar manner previously described. The inductive system 214 is coupled to remaining circuitry 804 configured according the particular implementation. For example, when the electronic control key 802 is configured as a key fob, then the remaining circuitry 804 may include the COM circuitry 202, the DIST circuitry 204, the MEMS circuitry 206, and the battery 208 along with any of one or more antennas and other supporting circuitry. When instead the electronic control key 802 is configured as a mobile phone such as the mobile phone 602, then the remaining circuitry 804 may include the low power domain 604 and any other remaining circuitry 608 as previously described.

In this case, a button 806 is included and coupled to the inductive system 214. The button 806 may be configured in any suitable manner, such as a physical push button located on the body or chassis of the key fob or mobile phone or the like. The button 806 may be an existing button on the electronic control key 802 having a normal function during normal operation. For example, a key fob may have a remote keyless entry (RKE) open or close button, trunk open button, etc. A mobile phone may have a home button, a volume button, a power button, etc. When the inductive system 214 is used for power and COM functions, the existing button 806 is repurposed for a security check as further described herein. Alternatively, the button 806 may be an additional button that is dedicated to the security check. In some embodiments, the user may program the inductive system 214 to sense activation or pressing of the button 806 during inductive link operation.

Figure 9:
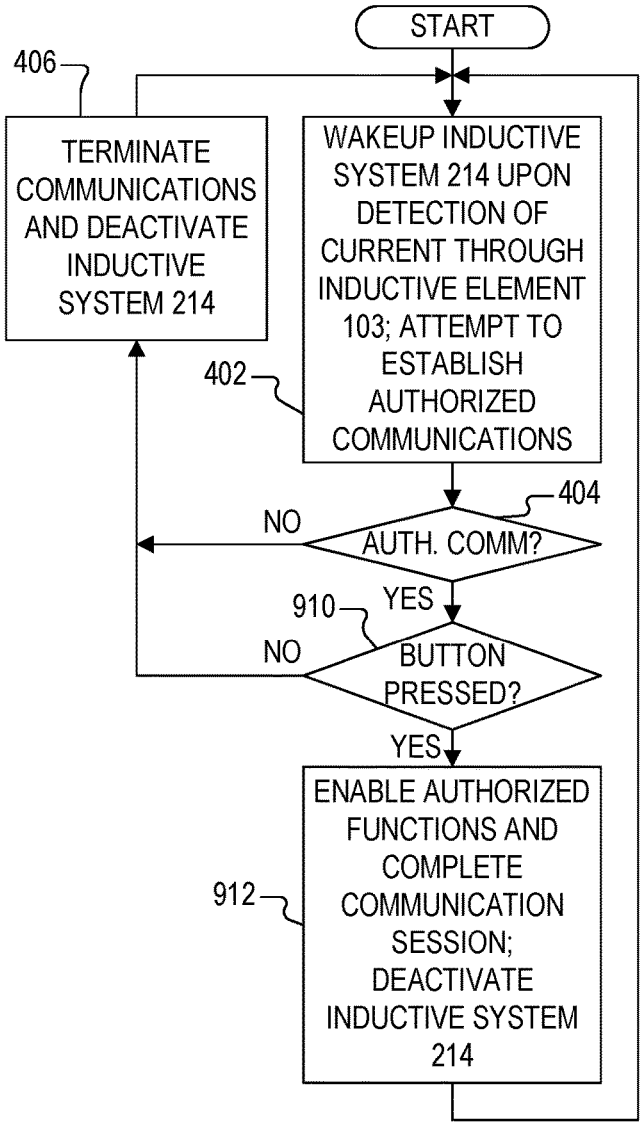
FIG. 9 is a flowchart illustrating operation of the electronic control key of FIG. 8 during inductive linking according to one embodiment of the present disclosure.

FIG. 9 is a flowchart illustrating operation of the electronic control key 802 during inductive linking according to one embodiment of the present disclosure. The blocks 402, 404, and 406 are included and operate in substantially similar manner as previously described in FIG. 4. When authorized communications are established as determined at block 404, operation advances to block 910 in which the inductive system 214 determines whether the button 806 is pressed. If the button 806 is not pressed, operation loops back to block 406 previously described in which communications are terminated and the inductive system 214 deactivated. If the button 806 is pressed, then operation advances to block 912 similar to blocks 416 and 712 previously described, in which the authorized functions are enabled by the inductive system 214, the current communication session is completed, and then the inductive system 214 is deactivated and put back to sleep. Operation is completed and may loop back to block 402 previously described.

For the electronic control key 802, the decision to enable the authorized functions is determined by pressing of the button 806. When the authorized user 302 needs to perform any of the authorized functions during inductive linking, then the authorized user 302 places the electronic control key 802 within the coupling zone 108 as previously described and presses the button 806.

Referring back to FIG. 3 illustrating the attack scenario, even if the first attack equipment 308 sufficiently close to the electronic control key 802 to establish an inductive link 310, the first thief 306 likely does not have physical access to the electronic control key 802 and thus is unable to press the button 806. In this manner, the attack is thwarted.

Figure 10:
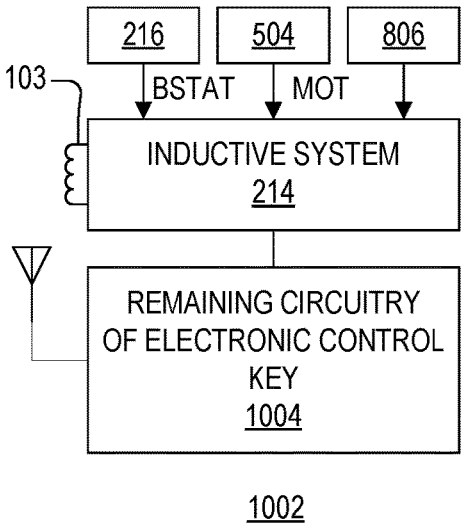
FIG. 10 is a simplified block diagram of an electronic control key implemented according to an embodiment of the present disclosure illustrating multiple security checks. which may be used alone or in any combination.

FIG. 10 is a simplified block diagram of an electronic control key 1002 implemented according to an embodiment of the present disclosure illustrating a combination of security checks. The electronic control key 1002 includes the inductive system 214 coupled to the inductive element 103 in a similar manner previously described. The inductive system 214 is coupled to remaining circuitry 1004 configured according the particular implementation, similar to that described for the remaining circuitry 804. The battery status circuitry 216, the motion detector 504, and the button 806 are shown coupled to the inductive system 214. In this configuration, any one security check, or any combination of two or three security checks may be enabled. For a combination of security checks, the inductive system 214 may check battery status via BSTAT (and perform secure distance check if GOOD) and also query MOT for authorized motion for enabling authorized functions; the inductive system 214 may check battery status via BSTAT (and perform secure distance check if GOOD) and also determine whether the button 806 is pressed for enabling authorized functions; the inductive system 214 may query MOT for authorized motion and determine whether the button 806 is pressed for enabling authorized functions; or the inductive system 214 may check battery status via BSTAT (and perform secure distance check if GOOD), query MOT for authorized motion, and determine whether the button 806 is pressed for enabling authorized functions.

The electronic control key in any of the embodiments described herein includes security check circuitry that is incorporated within or otherwise used by an inductive system to enable authorized functions to be commanded via the inductive link. If the security check circuitry determines a potential attack, then authorized functions are not enabled and inductive link communications are terminated.

In some embodiments, the security check circuitry includes battery status circuitry that checks or otherwise evaluates the status of the battery of the electronic control key and that reports the status to the inductive system. If the battery is good, such as being sufficiently charged, then the inductive system forces distance measurement circuitry to perform a secure distance check to determine whether the electronic control key is within a predetermined threshold distance. If the electronic control key is not within the predetermined threshold distance, then the secure distance check fails so that the authorized functions are not enabled and inductive link communications are terminated.

In other embodiments, the security check circuitry includes a motion detector that reports motion to the inductive system. The inductive system evaluates motion of the electronic control key to determine whether an authorized motion is detected for determining whether to enable the authorized functions. In some embodiments, the authorized motion may simply be any type of motion that indicates that the electronic control key is moving. If the electronic control key is not moving, then the motion test fails so that the authorized functions are not enabled and inductive link communications are terminated. In other embodiments, the authorized motion is a predetermined or preprogrammed motion pattern created, chosen or otherwise selected by an authorized user. If the electronic control key does not move in accordance with the selected or programmed authorized motion pattern, then the motion test fails so that the authorized functions are not enabled and inductive link communications are terminated.

In yet other embodiments, the security check circuitry includes a button detected by the inductive system. The inductive system determines whether the button is pressed to determine whether to enable the authorized functions.

In other embodiments, a combination of security check circuitry may be included and selectively enabled.

Although the present invention has been described in connection with several embodiments, the invention is not intended to be limited to the specific forms set forth herein. On the contrary, it is intended to cover such alternatives, modifications, and equivalents as can be reasonably included within the scope of the invention as defined by the appended claims. For example, variations of positive logic or negative logic may be used in various embodiments in which the present invention is not limited to specific logic polarities, device types or voltage levels or the like. For example, logic states, such as logic low and logic high may be reversed depending upon whether the pin or signal is implemented in positive or negative logic or the like. In some cases, the logic state may be programmable in which the logic state may be reversed for a given logic function.

The terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements.

What is claimed is:

1. An electronic control key, comprising:
an inductive link;
an inductive system that receives power and enables communications via the inductive link; and
security check circuitry used by the inductive system to perform at least one security check to determine whether to enable authorized functions, wherein the security check circuitry comprises:
battery status circuitry that indicates a status of a battery; and
distance measurement circuitry that can perform a secure distance check; and
wherein the inductive system invokes the distance measurement circuitry to perform the secure distance check when the battery status is good and enables authorized functions only when the secure distance check passes.

2. The electronic control key of claim 1, wherein the distance measurement circuitry comprises a wireless ultra-wideband communication circuit.

3. The electronic control key of claim 1, wherein:
the security check circuitry comprises a motion detector; and
wherein the inductive system monitors the motion detector to perform a motion inquiry and enables the authorized functions when the motion inquiry passes.

4. The electronic control key of claim 3, wherein the motion inquiry comprises detected motion of the electronic control key.

5. The electronic control key of claim 3, wherein the motion inquiry comprises comparing detected motion detected by the motion detector with a predetermined characteristic movement of the electronic control key.

6. The electronic control key of claim 3, wherein the motion inquiry comprises comparing motion of the electronic control key with a programmed motion pattern.

7. The electronic control key of claim 1, wherein:
the security check circuitry comprises a button; and
wherein the inductive system enables the authorized functions only when the button is pressed.

8. The electronic control key of claim 1, wherein:
the security check circuitry comprises:
battery status circuitry that indicates a status of a battery;
distance measurement circuitry that can perform a secure distance check; and
a button; and
wherein the inductive system invokes the distance measurement circuitry to perform the secure distance check when the battery status is good, and wherein the inductive system only enables authorized functions when both the secure distance check passes and the button is pressed.

9. The electronic control key of claim 1, wherein:
the security check circuitry comprises:
a button; and
a motion detector; and
wherein the inductive system monitors the motion detector to perform a motion inquiry, and wherein the inductive system only enables authorized functions when the motion inquiry passes and the button is pressed.

10. An electronic control key system, comprising:
an electronic control key, comprising:
an inductive link;
an inductive system that receives power and enables communications via the inductive link; and
security check circuitry used by the inductive system to perform at least one security check to determine whether to enable authorized functions; and
an access system, comprising inductive power and communication circuitry that can inductively couple to the inductive system of the electronic control key via the inductive link when the inductive link is within a predetermined coupling zone distance of the inductive power and communication circuitry, wherein the security check circuitry comprises:

battery status circuitry that indicates a status of a battery of the electronic control key; and distance measurement circuitry that can perform a secure distance check between the electronic control key and the access system; and wherein the inductive system invokes the distance measurement circuitry to perform the secure distance check when the battery status is good and enables authorized functions only when the secure distance check passes and enables authorized functions only when the secure distance check passes.

11. The electronic control key system of claim 10, wherein:

the security check circuitry comprises a motion detector; and wherein the inductive system monitors the motion detector to perform a motion inquiry and enables the authorized functions only when the motion inquiry passes.

12. The electronic control key system of claim 11, wherein the motion inquiry comprises detected motion of the electronic control key.

13. The electronic control key system of claim 11, wherein the motion inquiry comprises comparing motion of the electronic control key with a programmed motion pattern.

14. The electronic control key system of claim 10, wherein:

the security check circuitry comprises a button; and wherein the inductive system enables the authorized functions only when the button is pressed.

15. A method of operating an electronic control key having a battery and an inductive link, comprising:

receiving power and establishing communications via the inductive link;

performing at least one security check; and enabling authorized functions only when each of the at least one security check passes wherein:

the performing at least one security check comprises:

checking status of the battery; and invoking a secure distance check when the battery status is good; and enabling the authorized functions only when the secure distance check passes.

16. The method of claim 15, wherein the performing at least one security check comprises performing a motion inquiry, and wherein the authorized functions are enabled only when the motion inquiry indicates an authorized motion.

17. The method of claim 15, wherein the performing at least one security check comprises detecting whether a button is pressed, and wherein the authorized functions are enabled only when the button is pressed.

* * * * *